US005960910A

United States Patent [19]

Traktovenko

[11] Patent Number: 5,960,910

[45] Date of Patent: Oct. 5, 1999

[54] DOUBLE DECK ELEVATOR CAB

[75] Inventor: Boris G. Traktovenko, Avon, Conn.

[73] Assignee: Otis Elevator Company, Farmington, Conn.

[21] Appl. No.: 09/001,993

[22] Filed: Dec. 31, 1997

[51] Int. Cl.[6] ..... B66B 11/02

[52] U.S. Cl. ..... 187/401; 187/414

[58] Field of Search ..... 187/401, 414, 187/902, 249

[56] References Cited

U.S. PATENT DOCUMENTS 1,001,524 8/1911 Holcomb ..... 187/249

1,199,174 9/1916 Gumbel ..... 187/401

FOREIGN PATENT DOCUMENTS 3-256988 11/1991 Japan ..... 187/401

4-49191 2/1992 Japan ..... 187/401

*Primary Examiner*—Christopher P. Ellis

*Assistant Examiner*—Thuy V. Tran

[57] ABSTRACT

A double deck elevator car comprises a double deck elevator cab 40 having two compartments 41, 42 suspended midway along its vertical length by isolation pads 46 to support frames 47, 48 disposed on stiles 17, 18. Non-contact, stroke limiting cab steadiers 49 are used at the upper end of the double deck cab 40.

2 Claims, 2 Drawing Sheets

FIG.1
Prior Art
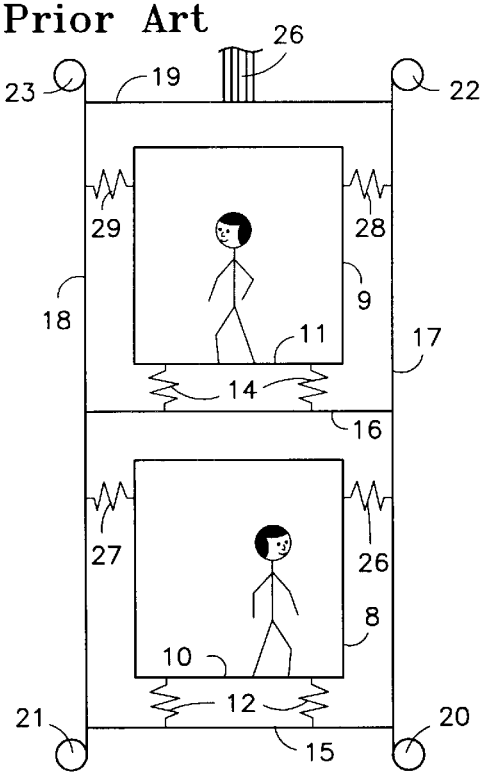
FIG.3
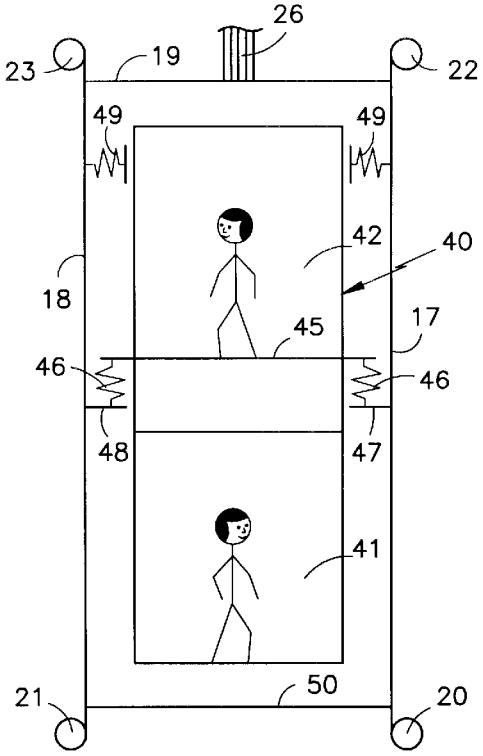
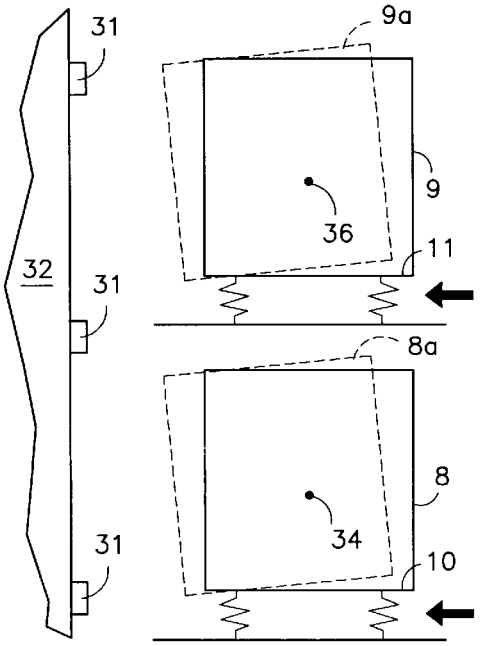
FIG.2
Prior Art
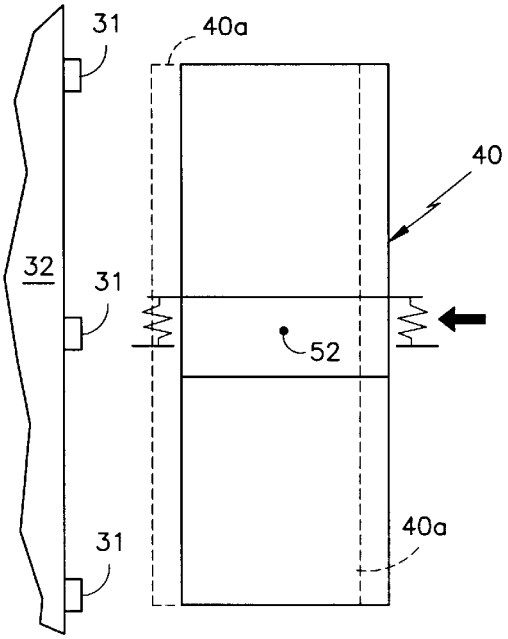
FIG.4

DOUBLE DECK ELEVATOR CAB

TECHNICAL FIELD

This invention relates to a double deck elevator cab formulated as a single mass within a double-deck sized elevator car frame to improve the ride and reduce noise within the cab.

1. Background Art

Double deck elevator cars are well known for use in very tall buildings. Double deck elevator cars known to the prior art have a common frame with two cabs mounted within it, one cab over the other. Each cab is mounted to the common frame in the same fashion as a cab is mounted to a single deck elevator car frame. Each cab is subjected to external forces and noise almost in the same way as is the cab of a single car, although the top cab may have a slightly smoother ride and slightly less noise than the lower cab.

2. Disclosure of Invention

Objects of the invention are provision of smoother and quieter rides in double deck elevator cars.

According to the present invention, a double deck elevator car utilizes a double deck elevator cab, suspended substantially midway along its vertical extent, to the elevator car frame, as a single mass. According further to the present invention, a double deck elevator car utilizes stroke-limiting steadiers which do not contact the cab except in the event of an extreme tilting motion, whereby to eliminate a path for acoustic noise to travel from the frame into the cab. According to the invention still further, the elevator cab is designed so that with equal loading of its upper and lower compartments, the center of gravity will be below the point of suspension on the isolation pads.

A double deck cab in accordance with the invention will have double the mass of the individual cabs known to the prior art, and therefore it will have four times as much moment of inertia than a single cab, thus reducing wind gust acceleration crated by passing the counterweight. Suspending the double deck cab midway along its vertical dimension causes all horizontal induced forces to be acting close to the center of gravity, thereby eliminating most rocking motion. The pathways for acoustic noise will be reduced from at least 16 to on the order of 6 or 8, and the noise is dissipated by twice as much mass, thereby reducing noise in the compartments.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a stylistic illustration of a double deck elevator car having two separate cabs known to the prior art.

FIG. 2 is a diagrammatic illustration of the prior art double deck elevator car of FIG. 1 as it responds to passing sills in a hoistway.

FIG. 3 is a stylistic illustration of a double deck elevator cab in accordance with the present invention.

FIG. 4 is a diagrammatic illustration of a double deck elevator cab of the invention as it passes sills in a hoistway.

BEST MODE FOR CARRYING OUT THE INVENTION

Figure 5:
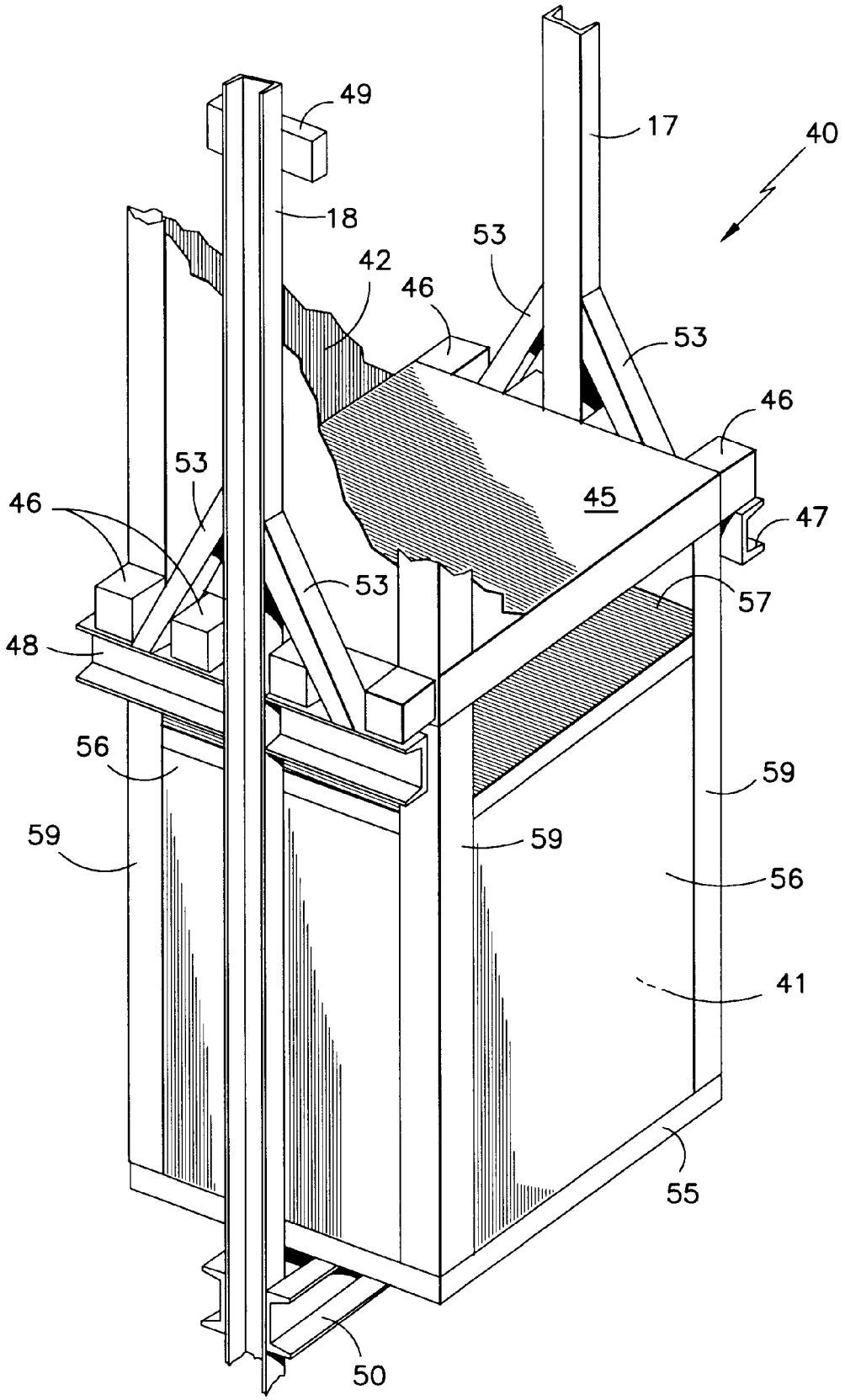
FIG. 5 is a simplified, partially broken away, perspective view of a double deck elevator cab in accordance with the present invention.

A typical double decker elevator car is illustrated in FIG. 1. A pair of totally separate cabs 8, 9 each having a platform

10, 11 mounted by means of corresponding isolation pads 12, 14 to respective support frames 15, 16 each of which rests on a safety plank (not shown) extending between a pair of stiles 17, 18, the upper end of which is joined by a crosshead 19 to which the ropes 26 are attached so as to raise and lower the car. A plurality of roller guides 20–23 are disposed on the upper and lower ends of the stiles 17, 18, in a known fashion, so as to guide the car between the guide rails (not shown) that extend through the hoistway in the building. The upper side of each cab is cushioned to an adjacent stile by means of cab steadiers to prevent the cab from swaying. As seen in FIG. 2, each cab reacts separately to applied forces. The center of gravity 34, 36 of each cab is well above the isolation pads, thus contributing to excessive noise and motion. FIG. 2 illustrates the effect when the elevator passes sills 31 at successive floor landings of a building 32. There is a leftward force on each cab (as shown by the arrows) which also causes the cab to tilt, as illustrated by the dashed lines 8*a*, 9*a*. Each cab would similarly react to bumps in the guide rails, and to sudden shifts of load within the individual cab. Furthermore, structure borne noise is a major component of noise in a cab for elevators with speeds up to 9 meters per second, the biggest contributor of noise being roller guides. The acoustic energy enters each cab through the two cab steadiers per cab, as well as through the isolation pads, of which there may be 6 or 8 per cab.

FIG. 3 briefly illustrates the principle of the present invention, which utilizes a single, double deck elevator cab 40 having two compartments 41, 42 one above the other. The double deck cab 40 is supported by framing at the level of the platform 45 of the top compartment 42 by means of isolation pads 46 disposed on a pair of support frames 47, 48, one supported by each stile 17, 18. A crosshead 19 joins the stiles at their upper ends, in the usual fashion, and a safety plank 50 joins the stiles at their lower ends. The car frame utilizing a double deck cab 40 will have the usual roller guides 20–23.

Because the double deck cab 40 is suspended in its vertical center, a lateral translation of either compartment 41, 42 as a result of a rail bump will be about half of what it would be in the prior art. For instance, if a bump in the rail causes the roller guide 20 to be thrust to the left, the platform 45 will move only one-half the distance of that thrust, whereby the lower cab moves by about half the distance which the prior art cab of FIG. 1 would move.

As can be seen in FIG. 4, since any lateral forces, represented by the arrow, are applied very near to the center of gravity 52, there is no tilting of the cab from lateral forces. Further, since the cab 40 passes several sills at a time, there is no lateral acceleration from sills, as shown by the dashed lines 40*a*. Because the mass is twice as great as the individual cars of the prior art, the inertia will be four times that of the inertia of a single cab. This will also reduce effects from sills and significantly reduce wind gust acceleration from passing the counterweight, to about 20% or 25% that which is experienced in the prior art cabs. Having a single cab means the car is aerodynamically streamlined, (eliminates aerodynamic disjoint in the middle of the car), minimizing turbulence forces as well as aerodynamic noise.

Because the double deck cab 40, suspended near its center of gravity, is far more stable, with less static tilting and less dynamic rocking, non-contact stroke-limiting cab steadiers 49 may be utilized.

Referring now to FIG. 5, the single, double deck cab 40 is seen supported on the support frames 47, 48 by means of the isolation pads 46. The support frames 47, 48 are joined to the stiles 17, 18 and provided with braces 53. In addition to the platform 45, 55, each compartment 41, 42 will have panels 56 and a canopy 57 in the usual fashion. The double deck cab 40 of the present invention will require additional strength in vertical support members 59 to support the platform 55 of the lower cab from the platform 45 of the upper cab. Only one non-contact, stroke-limiting cab steadier 49 is illustrated in FIG. 5. The door of the elevator has not been shown for clarity.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A double deck elevator car comprising:

a single, double deck elevator cab having one compartment above another;

an elevator car frame having a crosshead to which ropes are attached for supplying vertically upward force to the elevator car, a pair of stiles extending downwardly from either end of said crosshead, and a safety plank joining the lower ends of said stiles, a pair of horizontal support frames, each disposed substantially midway along one of said stiles and extending in a direction substantially perpendicular to the direction of said crosshead; and a plurality of isolation pads disposed substantially midway along the vertical extent of said double deck elevator cab for fastening said double deck elevator cab to said support frames.

2. A double deck elevator car according to claim 1 further comprising:

a pair of non-contact stroke-limiting cab steadiers, one disposed adjacent the upper end of said double deck elevator cab on each of said stiles.

* * * * *